US005604082A

United States Patent [19]

Henderickx et al.

[11] Patent Number: 5,604,082

[45] Date of Patent: Feb. 18, 1997

[54] METHOD FOR PROCESSING AN EXPOSED PHOTOGRAPHIC SILVER HALIDE MATERIAL

[75] Inventors: Freddy Henderickx, Olen; Hieronymus Andriessen, Beerse; Ann Verbeeck, Begijnendijk, all of Belgium

[73] Assignee: AGFA-Gevaert, N.V., Mortsel, Belgium

[21] Appl. No.: 594,722

[22] Filed: Jan. 31, 1996

[30] Foreign Application Priority Data

Feb. 21, 1995 [EP] European Pat. Off. ..... 95200418

[51] Int. Cl.[6] ..... G03C 5/29

[52] U.S. Cl. ..... 430/481; 430/440; 430/441; 430/442; 430/446; 430/480; 430/483; 430/486; 430/487

[58] Field of Search ..... 430/440, 441, 430/442, 446, 480, 481, 483, 486, 487

[56] References Cited

U.S. PATENT DOCUMENTS

| | | | |
|---|---|---|---|
| 3,984,243 | 10/1976 | Shimamura et al. | 430/490 |
| 4,254,215 | 3/1981 | Kramp et al. | 430/488 |
| 4,897,340 | 1/1990 | Ohtani et al. | 430/446 |
| 5,298,372 | 3/1994 | Okutsu et al. | 430/434 |
| 5,474,879 | 12/1995 | Fitterman et al. | 430/486 |

*Primary Examiner*—Hoa Van Le
*Attorney, Agent, or Firm*—Breiner & Breiner

[57] ABSTRACT

A method has been disclosed of processing an exposed silver halide photographic material comprising at least one coated hydrophilic silver halide emulsion layer comprising tabular grains rich in chloride, bounded by [100] or [111] major faces, characterized by the steps of developing, followed by fixing, rinsing and drying the said material, wherein developing proceeds in a developer, comprising hydroquinone in an amount from 0 to 30 g per liter, an auxiliary developer, as silver halide complexing agents alkali metal sulphite salts in an amount from 1 to 50 g per liter, at least 1 g of a compound corresponding to the formula (I), a precursor thereof, a derivative thereof and/or a metal salt thereof

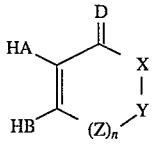

(I)

wherein the substituents are defined in the main embodiment of the specification.

15 Claims, No Drawings

METHOD FOR PROCESSING AN EXPOSED PHOTOGRAPHIC SILVER HALIDE MATERIAL

1. FIELD OF THE INVENTION

The present invention relates a method of processing an exposed photographic silver halide material coated from hydrophilic layers comprising thin tabular emulsion crystals rich in chloride.

2. BACKGROUND OF THE INVENTION

It is known that by processing a silver halide photographic material finely divided metallic silver, so-called silver deposit, is formed in the developer (ref. e.g. Photographic Silver Halide Diffusion Processes by A. Rott and E. Weyde—The Focal Press, (1972), p. 67). The formation of silver deposit is particularly disturbing in automatic processing apparatus wherein it results in deposits of black silver on conveyor and transport rollers and smudging of photographic material conducted therewith.

The formation of silver deposit can be attributed to the presence in conventional developers of silver halide complexing agents like, e.g., sulphite and thiocyanate ions, which make silver ions still more soluble. In this medium the complex ions formed are effectively reduced to metallic silver nuclei. Growth of said nearly invisible fine nuclei leads to the formation of said silver deposit.

It is clear that more soluble silver halide grains, especially grains rich in chloride and/or fine grains, coated in one or more hydrophilic layers of a silver halide photographic material, are promoting the formation of silver deposit, although otherwise their higher development and fixing rates are highly appreciated. Moreover not only fine regular or globular grains, having a small average crystal size diameter of about 0.25 μm or less are promoting the said formation, but also thin tabular grains having a grain thickness of less than about 0.2 μm.

The silver halide emulsions utilized in high-contrast room-light-handleable elements are slow speed emulsions. The desired slow speed is achieved by the use of small grain sizes and by the doping of the silver halide grains with appropriate doping agents that control photographic speed.

In order to prevent the formation of silver deposit it has been proposed to add particular compounds to the developer, forming sparingly soluble and non-reducible silver salts, as, e.g., 5,5'-bis-1,2,4-triazolin-3-thiones or derivatives of 1,3,4-thiadiazole-2-thiols as described, e.g. in BE-P 606,550 and GB-P 1,120,963, 2-mercapto-1,3,4-thiadiazoles described in U.S. Pat. No. 3,212,892. A great variety of other mercapto compounds has been described in FR-P 1,470,235 and 1-phenyl-5-mercapto-tetrazole compounds having a —NHX substituent on the phenyl nucleus have been disclosed in GB-P 1,471,554. In the latter document it has been described that the emulsion layer may contain auxiliary coating agents such as saponin, sodium lauryl sulphate, dodecylphenol polyethylene oxide ether and hexadecyltrimethyl ammonium bromide.

The same result can be obtained by the presence in the developer of 1-phenyl-5-mercaptotetrazole, but if it is used in an amount higher than necessary for reducing fog in the silver halide photographic material, the sensitivity of the said material is markedly reduced. Such effect is probably due to the penetrating of the 1-phenyl-5-mercaptotetrazole from the developer liquid into the exposed photographic silver halide emulsion layer and its interaction with latent image nuclei. More recently triazolium thiolates for use in the developer have been described in, e.g., EP-A 0 533 182.

In EP-Specification 0 223 883 a method has been described which comprises the treating of a silver halide photographic material with an aqueous alkaline liquid in the presence of (i) a developing agent, (ii) a heterocyclic mercapto compound including an aliphatic group of at least 3 carbon atoms and (iii) a surface active agent, characterized in that said surface active agent is an anionic alkylphenoxy polyalkyleneoxy phosphate ester surfactant.

In EP-A 0 620 484, reduction of the so-called "pi-line" defect, especially for processed materials for non-destructive testing purposes, has been described. Such materials should comprise at least one vinyl sulphone compound as a hardening agent and at least one polyoxyalkylene compound as a surfactant in at least one of its hydrophilic layers. Combined with a processing method comprising a developing step wherein the developer comprises as a surfactant at least one anionic alkylphenoxy and/or alkoxy polyalkyleneoxy phosphate ester, sulphate ester, alkyl carboxylic, sulphonic or phosphonic acid and/or a salt thereof a remarkable improvement has been obtained. A similar result has been obtained as disclosed in EP-A's 0 621 506 and 0 620 483.

Although said methods are very effective it is not more than a "treating method" wherein the amount of silver nuclei is not decreased but wherein said nuclei are more "dispersed" and are merely inhibited to grow further to form larger crystalline silver deposits. No "curing" effect in the sense of reducing the generation of nuclei can be obtained with this method. Moreover the stability of the developer, especially its sensitivity to oxidation by contact with air oxygen, is not reduced either.

As silver chloride is the more soluble silver halide salt, and therefor especially suitable in rapid processing applications, the problem of sludge formation by processing light-sensitive silver halide materials comprising such grains is more pronounced.

Otherwise during the last years there is an enhanced interest in the use of thin tabular grains rich in chloride, said grains having [111] or [100] major crystal faces. Especially for thin tabular grains rich in chloride, having [100] major faces, the stability of the crystal habit is a highly appreciated additional advantage.

It is generally known that the said thin tabular grains with their large surfaces are desired, e.g., as they allow the adsorption of high amounts of spectral sensitizer(s), leading to strong absorption of incident radiation. As a result a high sensitivity can be expected. Furthermore, as scattering of incident radiation throughout parallel twin planes is reduced, sharpness of the processed material is expected to be better. And last but not least the covering power of thin tabular grains comprised in coated layers of forehardened materials is not reduced in the processing of the said materials.

3. OBJECTS OF THE INVENTION

It is an object of the present invention to provide a processing method for a photographic silver halide material comprising hydrophilic layers having thin tabular silver halide crystals rich in chloride wherein the formation of silver deposit is reduced effectively without adversely affecting photographic speed.

It is a further object of the present invention to provide a suitable sensitometry for the said material processed in the method according to this invention.

Moreover it is an object to provide a procesing method, wherein the developer is stable against oxidation by air oxygen as a low regeneration volume per square unit of the said material should be highly appreciated.

Other objects and advantages of the present invention will become clear from the further description.

4. SUMMARY OF THE INVENTION

It has surprisingly been found now that the objects of the invention can be attained by providing a method of processing an exposed silver halide photographic material comprising at least one coated hydrophilic silver halide emulsion layer comprising tabular grains rich in chloride, bounded by [100] or [111] major faces, characterised by the steps of developing, followed by fixing, rinsing and drying the said material, wherein developing proceeds in a developer, comprising hydroquinone in an amount from 0 to 30 g per liter, an auxiliary developer, as silver halide complexing agents alkali metal sulphite salts in an amount from 1 to 50 g per liter, at least 1 g of a compound corresponding to the formula (I), a precursor thereof, a derivative thereof and/or a metal salt thereof

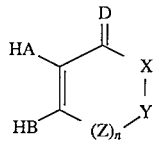

(I)

wherein each of A, B and D independently represents an oxygen atom or $NR^1$;

X represents an oxygen atom, a sulphur atom, $NR^2$; $CR^3R^4$; C=O; $C{=}NR^5$ or C=S;

Y represents an oxygen atom, a sulphur atom, $NR'^2$; $CR'^3R'^4$; C=O; $C{=}NR'^5$ or C=S;

Z represents an oxygen atom, a sulphur atom, $NR''^2$; $CR''^3R''^4$; C=O; $C{=}NR''^5$ or C=S;

n equals 0, 1 or 2;

each of $R^1$ to $R^5$, $R'^1$ to $R'^5$ and $R''^1$ to $R''^5$, independently represents hydrogen, alkyl, aralkyl, hydroxyalkyl, carboxyalkyl; alkenyl, alkynyl, cycloalkyl, cycloalkenyl, aryl or heterocyclyl;

and wherein $R^3$ and $R^4$, $R'^3$ and $R'^4$, $R''^3$ and $R''^4$, may further form together a ring; and wherein in the case that $X{=}CR^3R^4$ and $Y{=}CR'^3R'^4$, $R^3$ and $R'^3$ and/or $R^4$ and $R'^4$ may form a ring and wherein in the case that $Y{=}CR'^3R'^4$ and $Z{=}CR''^3R''^4$ with n=1 or 2, $R'^3$ and $R''^3$ and/or $R'^4$ and $R''^4$ may form a ring. Said developer further optionally comprises at least one thiocyanate salt in an amount from 0.1 to 3.0 g, and more preferably from 0.5 to 2.5 g per liter or a compound corresponding to the formula (II), accompanied by charge compensating anions, in amounts from 0.1 to 5 g and more preferably from 0.5 to 2.5 g per liter;

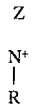

(II)

wherein at least R or one of the ring substituents contains at least one oxyethylene group; or wherein R is an aliphatic or aromatic group and wherein Z' is composed of atoms to form a heterocyclic aromatic 5- or 6-ring.

5. DETAILED DESCRIPTION OF THE INVENTION

It has unexpectedly been found that a solution of the problem of silver deposit by processing a silver halide photographic material comprising at least one coated hydrophilic silver halide emulsion layer containing thin tabular grains rich in chloride can be solved by applying a processing cycle characterised by the steps of developing, followed by fixing, rinsing and drying the said material, wherein developing proceeds in a developer, the essential elements of which are given hereinbefore in the statement of the invention.

In a preferred embodiment for the compound according to formula (II), found as working equivalent as alkali metal thiocyanates in the proposed amounts, the said heterocyclic aromatic ring is a pyridine, a pyrimidine, an imidazol, a benzimidazol, a thiazol, a benzothiazol or a derivative thereof. In a further preferred embodiment in the structure according to the formula (I) at least R or one of the ring substituents represents at least 3 oxyethylene units.

More specifically, a preferred compound is

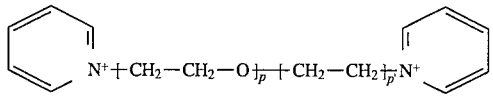

wherein p=3 to 10 and p'=1 to 4; and still more preferred the same compound wherein p equals a value of about 4, whereas p' equals a value of 1. As pyridinium cations are present, anions are required to neutralize the total electrical charge of these N-heterocyclic aromatic onium compounds. Preferred anions are sulphonate anions, like methylsulphonate and the like, toluyl sulphonate, carbamate, benzoate, glutamate, perchlorate, sulphate etc. In a more preferred embodiment the said anions are p-toluyl sulphonate.

In a further preferred embodiment according to the method used according to this invention, developing proceeds in a developer comprising a compound according to the formula (I) wherein A, B and X each represent an oxygen atom; n=0; $Y{=}CH{-}(CHOH)_m{-}CH_2{-}R^6$ wherein m=1, 2, 3 or 4 and wherein $R^6$ represents OH for m=1; H or OH for m=2, 3 or 4. This formula corresponds with (iso)ascorbic acid, which is, together with 1-ascorbic acid, a preferred form of formula (I). In another preferred embodiment A and B each represent an oxygen atom; n=0 and each of X and Y represents $C(CH_3)_2$. This formula corresponds with tetramethylreductic acid.

In the developing step of the method according to this invention the compound(s) according to formula (I) preferably is(are) present in the developer solution in an amount comprised between 1 g and 50 g per liter. Examples of reducing precursor compounds have, e.g., been described in WO's 94/3834 and 94/16362, which are both incorporated herein by reference.

It is clear that within the context of this invention ascorbic acid is not merely used in the developer as an antioxidant as, e.g., described in WO 93/12463, in JP-A's 4428673 and 55149936, in GB 1,266,533 and in U.S. Pat. Nos. 3,865,591; 4,756,997 and 4,839,259 and in the literature as, e.g., J. Am. Chem. Soc., 60 (1938), p. 99 and p. 2084; 61 (1939), p. 442; 64 (1942), p. 1561, 65 (1943), p. 1489; 66 (1944), p. 700 and 104 (1982), p. 6273.

In the developing step of the method according to this invention the developer liquid may contain any combination of hydroquinone as a developing agent and auxiliary developer known for use in the development of exposed photographic silver halide, but the absence of hydroquinone is not excluded. For example as auxiliary developing compounds may be utilized p-methylaminophenol, a 1-phenyl-3-pyrazolidine-1-one, p-phenylenediamine derivatives and the like. Amounts of hydroquinone are lower than 30 g per liter and more preferably lower than 20 g per liter. Preferred amounts of auxiliary developer are present in a concentration range of up to 10 mmoles per liter of developer, said auxiliary developer being preferably a 1-phenyl-3-pyrazolidine-1-one compound, well-known as a "phenidone" compound.

Further in the developing step of the method according to this invention the developer further comprises silver complexing compound(s) such as alkali metal sulphites, bisulphites, metasulphites or metabisulphites, but preferably it contains an alkali metal sulphite salt, and more preferably sodium sulphite, in an amount of less than 50, and more preferably in an amount of less than 40 g per liter of developer. The developer solution can be alkalized with alkaline metal hydroxides, phosphates, borates, carbonates and the like. The developer liquid or activator liquid may contain still other ingredients, e.g., metal complexing agents, an anti-fogging agent, e.g., alkali metal bromide, in amounts ranging from 0.01 to 0.4 moles per liter, a benzotriazole, a benzothiazole, a tetrazole, e.g., up to 0.06 g per liter of 1-phenyl-5-mercapto-tetrazole, solvents improving the dissolution of the developing agents, e.g., alcohols, polyethylene glycols and esters thereof and alkanolamines, surface active agents, development retarding or activating compounds, e.g., quaternary ammonium salts, and gelatin hardening agents, e.g., dialdehyde compounds such as glutardialdehyde. Especially the presence of polyethylene glycols having a low molecular weight in the range from 200 to 400 is preferred.

In the developing step of the method according to this invention, values of the pH of the developer solution are preferably in the range from 9.0 to 12.5, more preferably in the range of 9.5 to 12.0 and still more preferably from 9.5 to 11.0. Even at those relatively "lower" pH values, if compared with more frequently used alkaline pH values of 12.0 and more, the required sensitometry is still attained, which means that a developer having a composition according to this invention offers enough reactivity to get the required sensitivity for a material that is processed therein within a reasonable processing time.

The present invention thus includes a method for developing, by means of the developer according to this invention, of any type of photographic silver halide emulsion layer material, e.g., a graphic art, micrographic and an X-ray recording material, after image-wise exposing the said material by means of suitable radiation sources, adapted to each application in particular, and immersing it into the developer the composition of which has been described hereinbefore, with the proviso that the said material comprises at least one coated hydrophilic silver halide emulsion layer containing tabular silver halide grains rich in chloride.

The said tabular silver halide grains rich in chloride, coated in hydrophilic layers of materials to be processed according to the method of this invention, are bounded by [100] or [111] major faces. Tabular silver halide grains rich in chloride, bounded by [100] major faces and/or the preparation method thereof and/or materials in which said grains are incorporated have been described in, e.g., U.S. Pat. Nos. 5,264,337; 5,275,930; 5,292,632; 5,310,635; 5,314,798; 5,320,938: in the published EP-A's 0 534 395, 0 569 971, 0 584 815, 0 584 644, 0 617 325, 0 618 492 and 0 653 669, which is incorporated herein by reference. Tabular silver halide grains rich in chloride, bounded by [111] major faces and/or the preparation method thereof and/or materials in which said grains are incorporated have been described in, e.g., U.S. Pat. Nos. 4,399,215; 4,400,463; 4,804,621; 5,061,617; 5,176,991; 5,176,992; 5,178,997; 5,178,998; 5,183,732; 5,185,239; 5,217,858; 5,221,602; 5,264,337; 5,272,052; 5,275,930; 5,286,621; 5,292,632; 5,298,385; 5,298,387; 5,298,388; 5,310,644; 5,320,938; 5,356,764; in the published EP-A's 0 481 133, 0 503 700, 0 532 801, 0 533 189, 0 647 877 and 0 678 772, which are incorporated herein by reference.

The said tabular silver halide grains rich in chloride comprised in silver halide photographic materials to be processed according to the method of this invention preferably have an average thickness over the total crystal population of less than 0.5 μm, more preferably of less than 0.3 μm and still more preferably from 0.05 μm to 0.2 μm. As an average aspect ratio, defined as the ratio, calculated from the measurements of the equivalent diameter of a circle having the same surface area as the different individual grains, and its thickness, is preferably higher than 2:1; more preferably higher than 5:1 and still more preferably higher than 8:1, up to a ratio of about 100:1.

Silver halide emulsions incorporated in at least one photosensitive layer in a suitable layer arrangement of the said materials processed by the method according to this invention are composed of preferred amounts of chloride, in mole %, of at least 50%, more preferably at least 70% and even more preferably at least 90%, up to 100%. Other halides present are bromide, in amounts from 0 up to 50 mole % and iodide in amounts from 0 up to 2 mole %.

The processing steps according to the present invention are advantageously applied in automatic processing equipment, preferably containing conveyer rollers as described, e.g., in U.S. Pat. No. 3,025,779 and 3,545,971, in a time from 5 to 45 seconds at a temperature from 25° to 40° C.

Preferably during the processing according to the method described herein, concentration of the derivatives corresponding to formula (I) and the pH are maintained at a constant value by replenishment with unoxidized developing agent, thereby adding a concentrated alkali hydroxide solution under controlled constant redox potential as has been illustrated in EP-A 0 552 511, which is incorporated herein by reference. This invention allows the use of low regeneration amounts for the developer used in the developing step according to the method of this invention, having a composition wherein minimum regeneration amounts of developing solution from 50 to 250 ml/m$^2$ of photographic material are possible and even more preferred from 50 to 150 ml/m2.

Photosensitive silver halide emulsion layer(s) present in silver halide photographic materials processed by the method according to this invention may be of any type or composition used in silver halide photography, provided that at least one layer comprises at least one thin tabular silver halide emulsion rich in chloride bounded by [100] or [111] major faces and may be present in whatever a layer arrangement used in the art of photography. So black-and-white silver halide films intended to be used for contact exposures form an important class of photographic films. These so-called contact films are used for proper reproduction on one hand and for dry dot-etching on the other hand. In modern pre-press graphic arts these contact materials are designed to be usable for several minutes under roomlight conditions, meaning light containing substantially no UV-light. Accurately reproducing the relative proportions of white and black areas of a dot or line image implicates high contrast and high image density. Contact materials usually are processed in Rapid Access chemistry containing hydroquinone, but they give equal or better results, concerning contrast or image density, in Rapid Access chemistry containing ascorbic acid or ascorbic acid derivatives instead of hydroquinone.

The present invention is illustrated by the following examples without, however, limiting it thereto.

6. EXAMPLES

Methods to determine quantitatively the silver deposit present in developing solutions used in the processing of silver halide photographic materials have ever been difficult to be carried out unambigeously. Many factors are indeed playing a role in the phenomenon related to silver deposit:

a. with relation to the film material, the determining factors can be summarized as: the ratio of the exposed to the unexposed surface part of the film (as this ratio is determining the chemical and physical dissolution reactions); water absorption (determined by the degree of hardening of the material); grain size of the emulsions (determining the solubility of the said grains); type of gelatin used in the coated layers; stabilizing compounds (determining silver complexation and adsorption in the rinsing step of the processing) and spectral sensitization (also related with adsorption).

b. with relation to the developer: the sort and the amounts of compounds promoting the solubility of silver ions, the pH value having an influence on complexation, the total volume of the developer in the processing machine and the regeneration volume.

c. with relation to the processing, the agitation and squeezing throughout the rollers, the temperature, the developing time, the simultaneous use of different types of films and the cross-over.

Method

The method for determining the silver deposit makes use of the GEVASET 437N automatic processor, trademarked product from Agfa-Gevaert, which has a tank volume of only 1 liter per tank. The temperature and the processing velocity are made variable. As there is only one roller before entering and after leaving every bath, there is no danger to disturb the outlook of the film surface. Moreover the agitation of the developer is reduced to a negligable extent and the developer tank is followed by two fixation tanks and one rinsing tank, both having a content of 1 liter. At a velocity of 25 cm/min, the film is immersed into the developer tank for 46 seconds at a temperature of 30° C. The developer is not regenerated. In the exhaustion experiment, 15 sheets of film, together being equal to a total surface of 1 $m^2$, were processed: 10 sheets were unexposed and 5 sheets of film were completely exposed during 10 minutes in roomlight. The sheets were processed consecutively in the following order: two unexposed films, one exposed film etc.. After exhaustion 1 l of developer was taken from the developer in order to avoid deposit of silver on the walls of the developer tank. A sample thereof was taken to determine the amount of silver present by means of the atomic absorption spectrophotometric (A.A.S.) technique. The beaker was covered with a foil of cellofane and the content was filtered after 24 hours of sedimentation. During said 24 hours the silver deposit has the occasion to grow by agglomeration. The filtration was carried out under vacuum suction with a B üchner filter apparatus with a filtration paper Rotband Nr 589-5, the weight of which was determined before the operation started. After filtration the filter was rinsed with about 1 l of demineralized water, in order to remove the soluble salts of the developer. The filter paper was dried in an oven for 1 hour at 80° C., whereafter it was cooled for 90 minutes and weighed again. The difference in weight obtained gives an idea about the amount of silver deposit. After 4 weeks the procedure was repeated in order to detect the velocity of sedimentation. From the resulting filtrate a sample was taken to determine the amount of silver therein by means of A.A.S.. Experimental data are further given in Example 1.

Material A (cubic silver chloride emulsion)

This is a material having pure AgCl cubic crystals in its emulsion layers. It was prepared in the following way. A silver chloride emulsion having cubic silver chloride crystals was prepared by a double jet technique. The silver halide composition was 100 mole % of chloride and the average grain size was 0.55 μm. Therefor an amount of 615 ml of demineralized water was used as starting volume in the vessel, containing further 46 g of inert gelatin and 10.3 mmoles of sodium chloride at 60° C. Concentrated solutions of 1 l of $AgNO_3$ and NACl, 3 N each, were run with the double jet technique at a rate of 20 ml per minute for the silver nitrate solution during 50 minutes and at a rate of 20.83 ml per minute for the sodium chloride solution during 48 minutes. After an additional physical ripening time of 15 minutes at the end of the precipitation the flocculation procedure could begin: pH was adjusted at a value of 3.3 with a 3 molar solution of sulphuric acid, and 4.5 g of polystyrene sulphonic acid was added slowly in 2 minutes. The washing procedure was performed in a discontinous way, adding 3 l of demineralized water, containing up to 8 mmole of sodium chloride pro liter, until pAg was reaching a value of about 7.3. After addition of inert gelatin to a ratio of gelatin to silver nitrate in the emulsion of about 0.35, the emulsion was peptized and was chemically ripened to an optimal fog-sensitivity relationship at 52° C., pAg having a value of about 6.95. Chemical ripening agents, besides gold (in an amount of 0.019 mmole) and sulphur (tetramethyl thiodithiocarboxylic acid diamide in an amount of 0.061 mmole), were toluene thiosulphonic acid and iodide ions, both being predigestion agents in amounts of 0.02 and 8.6 mmoles respectively.

A photographic material was prepared having on a subbed polyester base a gelatinous silver halide emulsion of which the silver halide consists for 99.7% of silver chloride having an average grain size of 0.55 μm the preparation of which has been described above. Before coating said emulsion was spectrally sensitized with two spectral sensitizers, corresponding to the following formulae (see compound III and compound IV):

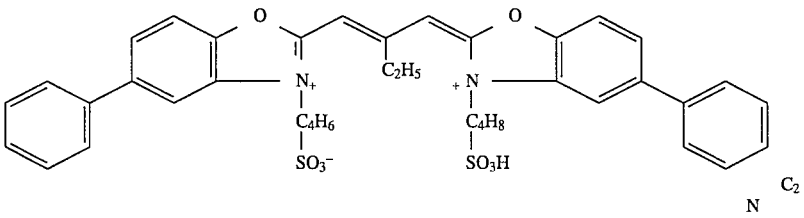

(III)

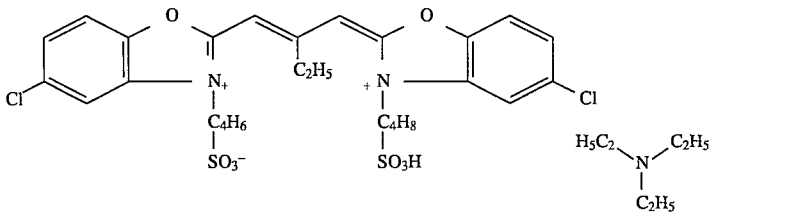

(IV)

These spectral sensitizers were added consecutively in an amount of 0.1 mmole and 0.3 mmole per mole of silver nitrate respectively. The emulsion was further stabilized with 0.22 mmole of compound (V) and 0.68 mmole of compound (VI) per mole of silver nitrate.

(V)

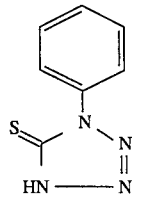

(VI)

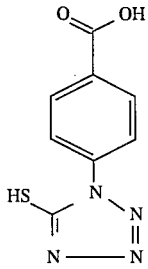

A coated amount of silver expressed as the equivalent amount of silver nitrate of 3.8 g per square meter and a gelatin to silver chloride (expressed in equivalent amount of silver nitrate) ratio of 0.35 was provided with a gelatin covering layer (anti-stress layer) of 1.30 g of gelatin per m2 on both sides of a polyethylene terephtalate film support having a thickness of 175 μm.

Material B (tabular silver chloride emulsion with major [111] faces)

The following solutions were prepared:

3 l of a dispersion medium (C) containing 0.444 moles of sodium chloride, 15 g of inert gelatin and 270 mg of adenine; temperature was established at 45° C. and pH was adjusted to 5.5;

a 2.94 molar silver nitrate solution (A);

a solution containing 4.476 moles of sodium chloride and 420 mg of adenin (B1);

A nucleation step was performed by introducing solution A and solution B1 simultaneously in dispersion medium C both at a flow rate of 30 ml/min during 30 seconds. After a physical ripening time of 15 min during which the temperature was raised to 70 ° C. and 97.5 g of gelatin and 1500 ml of water were added and the mixture was stirred for an additional 5 minutes. Then a growth step was performed by introducing by a double jet during 66 minutes solution A starting at a flow rate of 7.5 ml/min and linearly increasing the flow rate to an end value of 37.5 ml/min, and solution B1 at an increasing flow rate as to maintain a constant mV-value, measured by a silver electrode versus a saturated calomel electrode (S.C.E.), of +92 mV.

After cooling to about 40° C. the pH value of the said dispersing medium was adjusted to a value of 3.0 with sulphuric acid, and after the addition of 55.5 ml of polystyrene sulphonic acid the obtained flocculate was decanted and washed three times with an amount of 6 l of demineralized water in order to remove the soluble salts present.

Tabular silver chloride crystals having [111] major phase and a sphere equivalent average diameter of 1.20 μm were obtained, with an average thickness of 0.37 μm and thus an average aspect ratio of 3.3.

In order to evaluate the said emulsion B sensitometrically a photographic material was further prepared having on a subbed polyester base a gelatinous silver halide emulsion of which the silver halide consists for 100% of tabular silver chloride, the preparation and emulsion crystal characteristics have been given hereinbefore.

Before coating said emulsion was spectrally sensitized, in the presence of optimally chemical ripening amounts of sulphur and gold compounds, with a two spectral sensitizers, corresponding to the formulae (III) and (IV). These spectral sensitizers were added consecutively in an amount of 0.5 mmole and 0.2 mmole per mole of silver nitrate respectively. The emulsion was further stabilized with 0.45 mmole of compound (V) and 1.05 mmole of compound (VI) per mole of silver nitrate.

A coated amount of silver expressed as the equivalent amount of silver nitrate of 3.8 g per square meter and a gelatin to silver chloride (expressed in equivalent amount of silver nitrate) ratio of 0.35 was provided with a gelatin covering layer (anti-stress layer) of 1.30 g of gelatin per m2 on both sides of a polyethylene terephtalate film support having a thickness of 175 μm.

Material C (tabular silver chloride emulsion with major [100] faces)

The following solutions were prepared:

2 l of a dispersion medium (C) containing 20 mmoles of sodium chloride and 10 g of inert bone gelatin; temperature was established at 50° C. and pH was adjusted to 6.0;

a 2.94 molar silver nitrate solution (A);

a 2.94 molar sodium chloride solution (B1).

The temperature of A and B1 was established at 40° C.

A nucleation step was performed by introducing solution A and solution B1 simultaneously in dispersion medium C both at a flow rate of 60 ml/min during 30 seconds. After a physical ripening time of 20 min during which the temperature was raised to 70° C. Then a growth step was performed by introducing by a double jet during 64 minutes and 40 seconds solution A starting at a flow rate of 5 ml/min and linearly increasing the flow rate to an end value of 25 ml/min, and solution B1 at an increasing flow rate as to maintain a constant mV-value, measured by a silver electrode versus a saturated calomel electrode (S.C.E.), of +135 mV.

To this dispersion medium, after addition of 50 g of inert bone gelatin an amount of 1.25 mmole per mole of silver chloride was added of the dye anhydro-5,5'-dichloro-3,3'-bis(n-sulphobutyl)-9-ethyloxacarbo-cyanine hydroxide.

After cooling to about 40° C. the pH value of the said dispersing medium was adjusted to a value of 3.0 with sulphuric acid, and after the addition of 37 ml of polystyrene sulphonic acid the obtained flocculate was decanted and washed three times with an amount of 6 l of demineralized water in order to remove the soluble salts present.

The thus obtained silver chloride tabular emulsion showed a [100]-major faces. The average circle equivalent diameter $d_{EM}$, average thickness d, average aspect ratio AR were obtained from electron microscopic photographs. Respective values of 1.58 μm; 0.42 μm and 3.8:1 were measured.

A coated amount of silver expressed as the equivalent amount of silver nitrate of 3.8 g per square meter and a gelatin to silver chloride (expressed in equivalent amount of silver nitrate) ratio of 0.35 was provided with a gelatin covering layer (anti-stress layer) of 1.30 g of gelatin per m2 on both sides of a polyethylene terephtalate film support having a thickness of 175 μm.

Compositions of the developers

| Type of Dev. | DEV1 | DEV2 | DEV3 | DEV4 | DEV5 |
|---|---|---|---|---|---|
| pH ready-for-use | 10.5 | 10.0 | 10.0 | 10.0 | 10.0 |
| Hydroquinone (mole/l) | 0.27 | 0.18 | 0.18 | 0.18 | — |
| 1-phenyl-4-methyl-3-pyrazolidine-1-one (mmole/l) | 4.6 | 4.6 | 4.6 | 4.6 | 4.6 |
| $Br^-$ (mmole/l) | 33.6 | 21 | 21 | 21 | 21 |
| $SO_3^{--}$ (mole/l) | 0.57 | 0.19 | 0.19 | 0.19 | 0.19 |
| $CO_3^{--}$ (mole/l) | 0.22 | 0.44 | 0.44 | 0.44 | 0.44 |
| Polyglycol (ml/l) (M.W. = ca. 400) | 0.25 | 20 | — | 20 | 20 |
| $SCN^-$ (mmole/l) | 10.3 | 25.7 | — | — | — |
| Ascorbic Acid (mole/l) | — | 0.11 | 0.11 | 0.11 | 0.28 |
| $I^-$ (mmole/l) | 0.6 | — | — | — | — |
| compound (VII) (mmole/l) | — | — | 1.4 | — | — |

(VII)

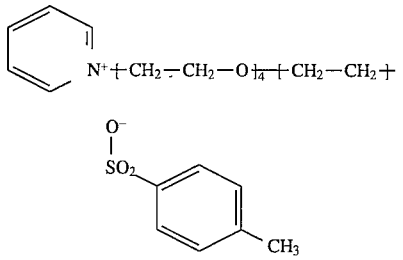

EXAMPLE 1

In Table 1 amounts, in mg/l, of deposited silver determined by means of the method described hereinbefore in Exhausted Developer (ED), after 24 hours (in mg/l) (ED24), after 4 weeks present in the filtrate (mg/l) (ED4W) as well as the Total Deposit (mg/l) (TD) and the rest amount of Deposited Silver in the Filtrate (DSF) are given for material A (regular cubic AgCl) and for materials B and C (tabular AgCl crystals with [111] and [100] major faces respectively), in the developers DEV1, DEV2 and DEV5.

TABLE 1

| Developer | Material | ED | ED24 | ED4W | TD | DSF |
|---|---|---|---|---|---|---|
| DEV1 (comp.) | A | 62.2 | 61.3 | 0.2 | 61.5 | 0.7 |
| DEV2 | A | 11.5 | 9.7 | 0.5 | 10.2 | 1.7 |
| (inv.) | B | 10.5 | 3.33 | 2.8 | 6.1 | 5.2 |
| | C | 12.5 | 10.2 | 0.4 | 10.6 | 1.7 |
| DEV5 (inv.) | C | 5.2 | 4.5 | 0.3 | 4.8 | 0.9 |

As can be concluded from Table 1 processing in the developer DEV2, according to the method of this invention, gives an amount of silver deposit that is 80% less in comparison with DEV1, a developer for materials with high chloride content, as described in EP-A 94203085, filed Oct. 24, 1994. The amount of silver deposit is comparable for the three materials (DEV2). The amount of silver deposit can be further diminished by using DEV5, a developer without isocyanate or compound VII and with ascorbic acid instead of hydroquinone.

Samples of the coating materials A, B and C were exposed according to the ANSI procedure 1043. After processing in the developers mentioned in Table 2 for developing times of 11 seconds at 33° C., the sensitometric properties of each material was measured.

Therefor the density was measured as a function of the light dose and therefrom were determined the following parameters:

fog level (with an accuracy of 0.01 density);

the relative speed at a density of 1 above fog (expressed in logarithmic terms of exposure amount: a decrease of the speed with 0.30 is equivalent with a speed enhancement with a factor 2);

the contrast, calculated between the densities 0.25 and 2.0 above fog and the covering power (CP), defined as the ratio of the maximum density Dmax and the amount in grams of developed silver in the same density region, multiplied by a factor 100.

The results obtained have been summarized in Table 2.

TABLE 2

| Developer | Mat. | Crystal habit | Fog | Speed | Contr. | Dmax | CP |
|---|---|---|---|---|---|---|---|
| DEV1 | A | cubic | 0.05 | 1.67 | 1.84 | 3.40 | 50 |
| (ref.) | | [111]-tabular | — | — | — | — | 37 |
| | | [100]-tabular | — | — | — | — | 22 |
| DEV2 | A | cubic | 0.05 | 1.66 | 1.77 | 3.60 | 50 |
| (inv.) | B | [111]-tabular | 0.20 | 1.50 | 2.80 | 2.97 | 36 |
| | C | [100]-tabular | 0.09 | 1.56 | 1.49 | 2.80 | 24 |
| DEV3 | A | cubic | 0.05 | 1.66 | 1.79 | 3.53 | — |
| (inv.) | B | [111]-tabular | 0.20 | 1.50 | 2.75 | 3.14 | — |
| | C | [100]-tabular | 0.07 | 1.62 | 1.42 | 2.65 | — |
| DEV4 | A | cubic | 0.03 | 1.87 | 2.25 | 3.22 | 43 |
| (inv.) | B | [111]-tabular | 0.11 | 1.50 | 2.85 | 3.30 | — |
| | C | [100]-tabular | 0.06 | 1.53 | 1.46 | 2.54 | 25 |
| DEV5 | A | cubic | 0.03 | 1.89 | 2.32 | 3.26 | 50 |
| (inv.) | B | [111]-tabular | 0.10 | 1.51 | 2.76 | 3.25 | 35 |
| | C | [100]-tabular | 0.05 | 1.53 | 1.51 | 2.71 | 28 |

The sensitometric results are matching those obtained with DEV1 and material A (as described in EP-A No. 94203085, filed Oct. 24, 1994) containing cubic AgCl emulsion crystals as has been illustrated in Table 2 for [111]-tabular AgCl crystals and for [100]-tabular AgCl crystals. The same sensitometric values can be obtained by using a developer with ascorbic acid instead of hydroquinone. Moreover the high covering power obtained with cubic crystals rich in chloride, described in the non-published EP-A is confirmed. The covering power obtained for cubic crystals rich in chloride is always better than for [100] and [111] tabular grains rich in chloride, but the tendency is present that there is a relative increase in covering power, especially for the tabular [100] grains versus the cubic grains, if developing occurs in developers used in the method according to this invention.

We claim:

1. Method of processing an exposed silver halide photographic material comprising at least one coated hydrophilic silver halide emulsion layer comprising tabular grains rich in chloride, bounded by [100] or [111] major faces, characterized by the steps of developing, followed by fixing, rinsing and drying the said material, wherein developing proceeds in a developer comprising hydroquinone in an amount from 0 to 30 g per liter, an auxiliary developer, as silver halide complexing agents alkali metal sulphite salts in an amount from 1 to 50 g per liter, at least 1 g of a compound corresponding to the formula (I), a precursor thereof, a derivative thereof and/or a metal salt thereof

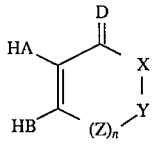

(I)

wherein each of A, B and D independently represents an oxygen atom or $NR^1$;

X represents an oxygen atom, a sulphur atom, $NR^2$; $CR^3R^4$: C=O; $C{=}NR^5$ or C=S;

Y represents an oxygen atom, a sulphur atom, $NR'^2$; $CR'^3R'^4$; C=O; $C{=}NR'^5$ or C=S;

Z represents an oxygen atom, a sulphur atom, $NR''^2$; $CR''^3R''^4$; C=O; $C{=}NR''^5$ or C=S;

n equals 0, 1 or 2;

each of $R^1$ to $R^5$, $R'^1$ to $R'^5$, and $R''^1$ to $R''^5$, independently represents hydrogen, alkyl, aralkyl, hydroxyalkyl, carboxyalkyl; alkenyl, alkynyl, cycloalkyl, cycloalkenyl, aryl or heterocyclyl;

and wherein $R^3$ and $R^4$, $R'^3$ and $R'^4$, $R''^3$ and $R''^4$, may further form together a ring;

and wherein in the case that $X{=}CR^3R^4$ and $Y{=}CR'^3R'^4$, $R^3$ and $R'^3$ and/or $R^4$ and $R'^4$ may form a ring and wherein in the case that $Y{=}CR'^3R'^4$ and $Z{=}CR''^3R''^4$ with n=1 or 2, $R'^3$ and $R''^3$ and/or $R'^4$ and $R''^4$ may form a ring.

2. Method according to claim 1, wherein the said developer further comprises at least one thiocyanate salt in an amount from 0.1 to 3.0 g per liter.

3. Method according to claim 1, wherein the said developer further comprises a compound corresponding to the formula (II), accompanied by charge compensating anions, in an amount from 0.1 to 5 g,

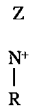

(II)

wherein at least R or one of the ring substituents contains at least one oxyethylene group or wherein R is an aliphatic or aromatic group and wherein Z' is composed of atoms to form a heterocyclic aromatic 5- or 6-ring.

4. Method according to claim 3, wherein the said charge compensating anions of the compounds according to the formula (II) present in the developer are at least one member selected from the group consisting of sulphonate, toluyl sulphonate, carbamate, benzoate, glutamate, perchlorate or sulphate anions.

5. Method according to claim 3, wherein in the formula (II) the said heterocyclic aromatic ring is a pyridine, a pyrimidine, an imidazol, a benzimidazol, a thiazol, a benzothiazol or a derivative thereof.

6. Method according to claim 1, wherein for the compound according to the formula (I) A, B and X each represent an oxygen atom; n=0; $Y{=}CH{-}(CHOH)_m{-}CH_2{-}R^6$ wherein m=1, 2, 3 or 4 and wherein $R^6$ represents OH for m=1; H or OH for m=2, 3 or 4.

7. Method according to claim 1, wherein for the compound according to the formula (I) A and B each represent an oxygen atom; n=0 and each of X and Y represents $C(CH_3)_2$.

8. Method according to claim 1, wherein the said developer has a pH value between 9.6 and 11.

9. Method according to claim 1, wherein the said compound according to the formula (I) is present in an amount between 1 g and 50 g per liter.

10. Method according to claim 1, wherein said auxiliary developer represents at least one 1-phenyl-3-pyrazolidine-1-one developing agent in a concentration ranging up to 10 mmoles per liter.

11. Method according to claim 1, wherein an alkali metal bromide salt is present in the developer in a concentration ranging from 0.01 to 0.4 moles per liter.

12. Method according to claim 1, wherein said tabular grains rich in chloride, bounded by [100] or [111] major faces, have an average thickness over the total crystal population of less than 0.5 μm and an average aspect ratio higher than 2:1.

13. Method according to claim 12, wherein said tabular grains have an average thickness over the total crystal population from 0.05 μm to 0.2 μm.

14. Method according to claim 12, wherein said tabular grains have an average aspect ratio from 5:1 to 100:1.

15. Method according to claim 1, wherein said tabular grains rich in chloride, bounded by [100] or [111] major faces, have amounts of chloride of at least 50 mole % , amounts of iodide from 0 to 2 mole %, the rest of the halide ions present being bromide.

* * * * *